United States Patent [19]

Zepp

[11] Patent Number: 5,012,837

[45] Date of Patent: May 7, 1991

[54] RATIO DEVICE FOR DISPENSING LIQUIDS

[75] Inventor: Lawrence P. Zepp, Fort Wayne, Ind.

[73] Assignee: Xolox Corporation, Fort Wayne, Ind.

[21] Appl. No.: 595,312

[22] Filed: Oct. 10, 1990

[51] Int. Cl.[5] ..... F04D 23/00

[52] U.S. Cl. ..... 137/99; 222/129.2; 417/405

[58] Field of Search ..... 137/99; 417/405; 222/129.2, 129.4

[56] References Cited

U.S. PATENT DOCUMENTS 4,448,256 5/1984 Eberhardt et al. ..... 417/405

*Primary Examiner*—Gerald A. Michalsky

*Attorney, Agent, or Firm*—Barnes & Thornburg

[57] ABSTRACT

A ratio device for dispensing first and second liquids in a preselected ratio, which comprises a housing assembly having two gear pumps interconnected for concurrent operation. One of the gear pumps is configured also to act as a liquid powered motor operative in response to the pressure and flow of the first liquid.

8 Claims, 5 Drawing Sheets

RATIO DEVICE FOR DISPENSING LIQUIDS

BACKGROUND OF THE INVENTION

This invention relates to an apparatus for dispensing predetermined quantities of different liquids, and more particularly to the dispensing of beverages made by blending preselected quantities of syrup and potable water.

PRIOR ART

Within the field of beverage mixing and dispensing, a typical system comprises a source of water under pressure, a water filter, a carbonation device, a source of syrup, a cooling mechanism and a dispensing valve. Such a system combines syrup and potable water in preselected quantities to make a finished beverage. Generally, this is accomplished by purifying and carbonating water, chilling the syrup and water, blending the proper ratio of water to syrup and dispensing the mixed beverage at fast flow rates without foaming. These systems are commonly referred to as post-mix systems.

Generally, the blending and dispensing of the beverage is accomplished by means of a variable orifice flow control valve containing valve devices that cover flow orifices, limiting flow, as liquid pressure is applied. A problem with this arrangement resides in the imprecise ratio control of the syrup and water such that successively dispensed beverages can have different quantities of syrup therein. This is typically caused by variations of pressure, syrup type, and temperature. Needless to say, this affects beverage taste which in some instances can be unsatisfactory.

SUMMARY OF THE INVENTION

The present invention provides a novel ratio device for dispensing first and second liquids to be mixed in a preselected ratio which comprises a housing assembly having two pairs of inlets and outlets. A first pair of oval gears in the housing are intermeshed such that rotation of such gears operates to receive a first liquid through the inlet and to force it out of the outlet of one of the two pairs. A second pair of oval gears in the housing are also intermeshed, rotation of these gears operating to receive the second liquid through the respective inlet and to force it out of the outlet thereof. Means are provided for interconnecting the first and second pairs of gears for concurrent rotation, the gear pairs being of different displacement such that the volume of the first liquid dispensed from the respective outlet is correspondingly different from the volume of the second liquid dispensed from its outlet. The outlets are fed into a common dispensing spigot from which a drinking vessel may be filled.

The gear arrangement is so configured that the first gears under the force of liquid under pressure admitted to the respective inlet acts as a motor or flow meter thereby to drive rotationally the second pair of gears.

In one embodiment of this invention, all of the gears are of the same oval size, gear size and gear pitch. The gears of the first pair are of the same thickness. The gears of the second pair also have the same but a different thickness. The means interconnecting the two gear pairs may be a shaft fixedly secured to one gear of each pair.

For providing lubrication of the gears within the respective chambers, the gears are provided with shallow recesses about the centers of rotation which are adapted to carry liquid therein that serves as a lubricating medium between the gears and the respective walls of the chambers and pockets that receive the gears.

More specifically, the chambers that receive each pair of gears have the shape of two intersecting circles which form two gear pockets that receive in sealing relation the respective gears. The chamber spaces between the pockets serve as inlet and outlet portions. Each pocket provides sealing engagement with the respective gear over a predetermined arcuate extent thereof. One of the drive gears has an arcuate portion exposed within its inlet chamber which extends between two seal points, one of these being with the other drive gear and the other being with the respective pocket. The arcuate portion so exposed provides a resultant force vector from the liquid pressure within the inlet chamber that intersects the radius of the one drive gear at a point offset from the gear center which provides a lever arm that urges the drive gear in a direction of driving rotation.

It is an object of this invention to provide an apparatus for blending and dispensing different liquids in relatively precise and repeatable quantities for making a mixed beverage.

It is another object of this invention to provide such an apparatus that is powered by the energy of the incoming flow of one of the liquids thereby making it unnecessary to utilize external power.

DESCRIPTION OF THE PREFERRED EMBODIMENT

Figure 1:
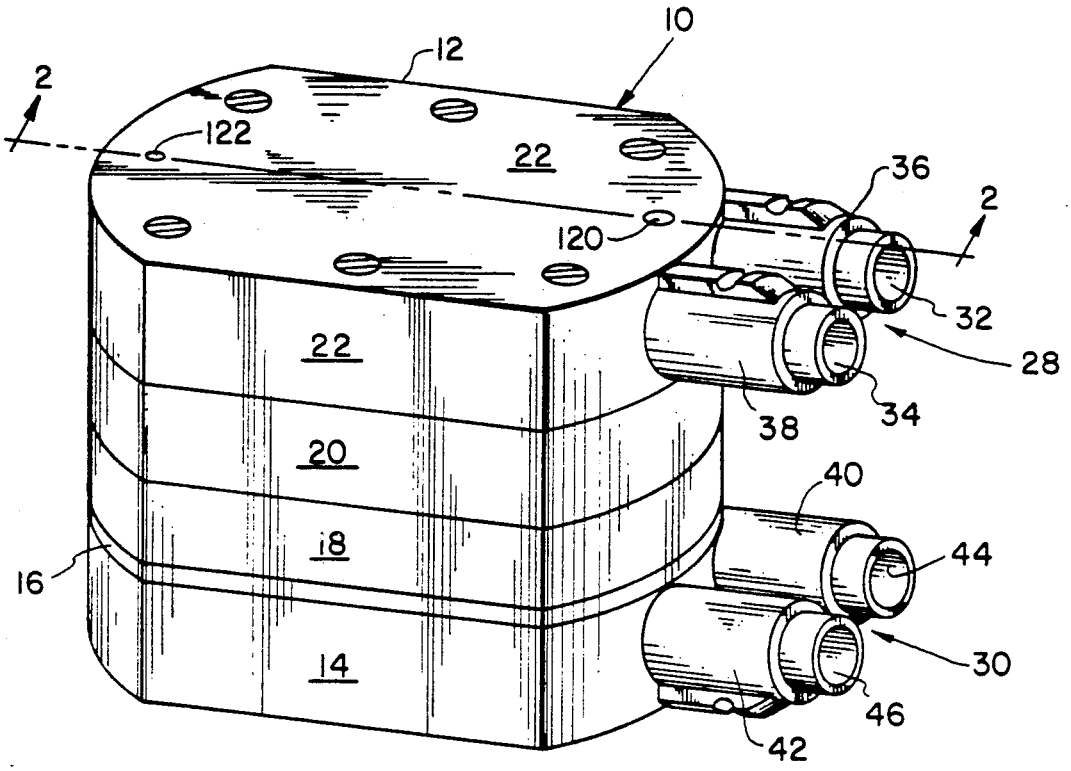
FIG. 1 is a perspective view of one embodiment of this invention.
Figure 2:
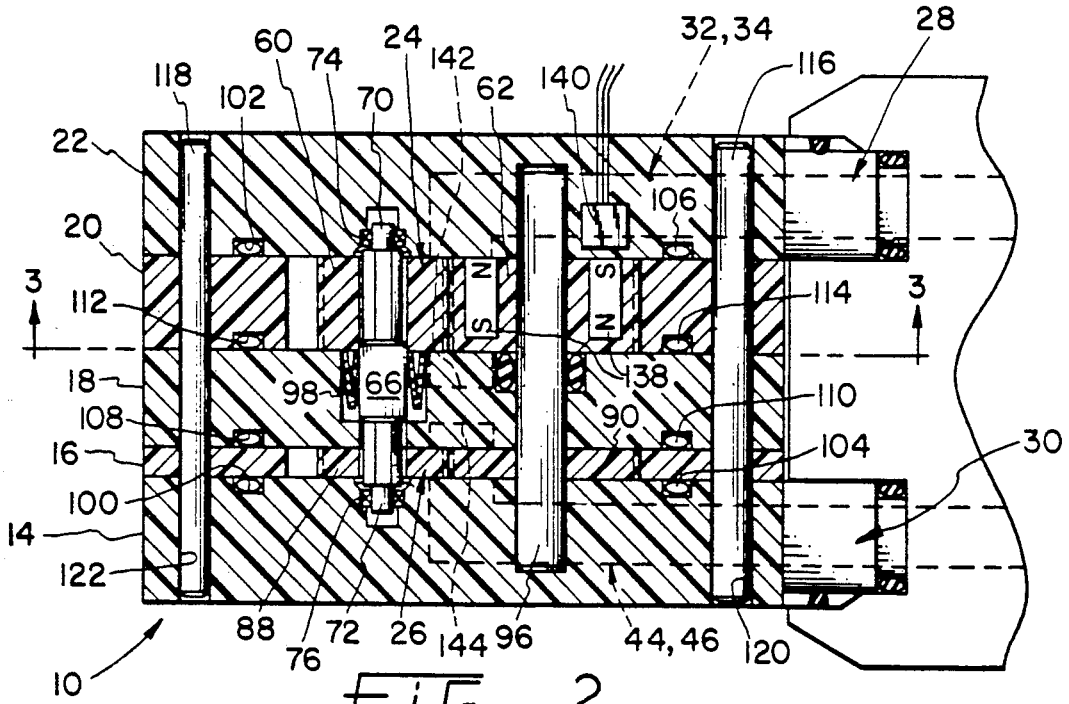
FIG. 2 is a cross-section taken substantially along the section line 2—2 of FIG. 1.
Figure 3:
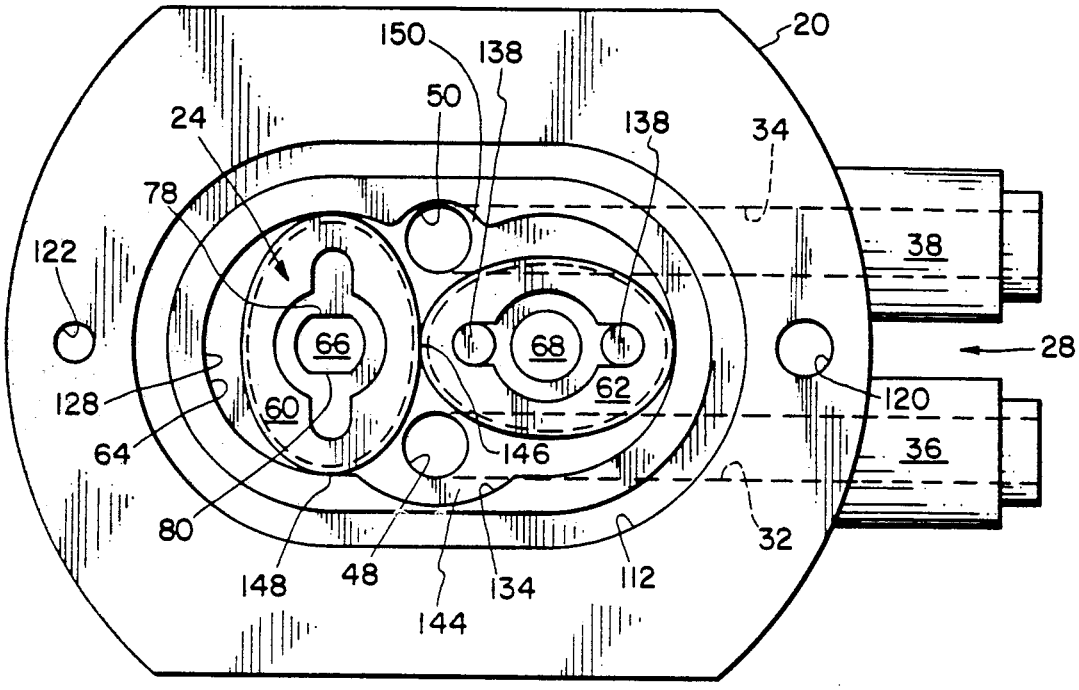
FIG. 3 is a cross-section taken substantially along the section line 3—3 of FIG. 2.
Figure 4:
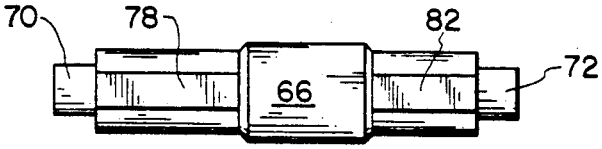
FIG. 4 is a side view of the drive shaft.
Figure 5:
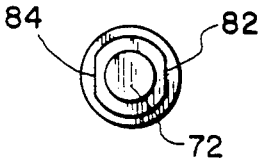
FIG. 5 is an end view thereof.

Referring to the drawings and more particularly to FIGS. 1-3, the ratio device of this invention is indicated generally by the reference numeral 10 and comprises a housing assembly 12 composed of five different sections 14, 16, 18, 20 and 22 molded of a suitable plastic. Generally, the housing assembly 12 encloses two separate gear pairs 24 and 26, intermeshed, as shown more clearly in FIG. 3, in the configuration of a conventional gear pump. The gear pairs 24 and 26 also molded of a suitable plastic are connected, respectively, to two pairs of inlet and outlet fittings 28 and 30 by means of passages 32, 34 and 44, 46 as shown. The fitting pair 28 is composed of an inlet fitting 36 and an outlet fitting 38. The two fittings 30 include an inlet fitting 40 and an outlet fitting 42. The pair of passages 32 and 34 are connected to companion ports 48 and 50 which communicate with the first gear pair 24 (FIG. 3). The second set of passages 44 and 46 connect to companion ports 56 and 58 (FIG. 10) that communicate with the gear pair 26. Thus, the inlet and outlet sides of the two gear pairs 24 and 26 are suitably ported to the exterior of the housing assembly 12 by the respective inlet and outlet fittings 36, 38, 40 and 42. As shown more clearly in FIG. 1, the passages 32, 34, 44, 46 as well as the respective fittings 28 and 30 are provided in the two end sections 22 and 14, respectively, of the housing 12.

The housing section 20 contains the first gear pair 24 which include two oval-shaped gears 60 and 62 received for rotation within chamber 64 (FIG. 3) by means of two shafts 66 and 68, respectively. The gear 60 is rotationally fixed to the shaft 66 which in turn has its opposite ends 70 and 72 (FIG. 2) journaled within suitable bearings 74 and 76 in the two housing sections 22 and 14, respectively, as shown. It will be noted that the ends 70 and 72 are of reduced diameter and are provided with right angle shoulders, the shoulder at end 72 engaging a suitable thrust bearing 76 of some suitable jewel bearing. The shaft 66 itself is formed of a suitably hard material having a relatively long wear-life.

Figure 6:
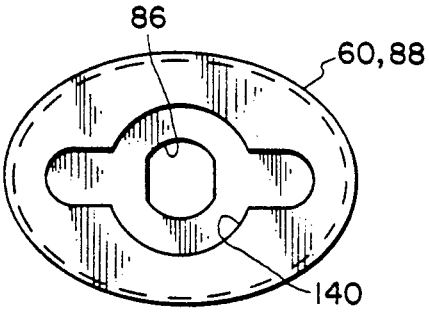
FIG. 6 is a side view of the drive gear of each of two gear pairs used in this invention.

The shaft 66 is formed with flats 78, 80 and 82, on the opposite end portions 84. The gear 60 is provided with a central opening 86 (FIG. 6) having a shape which fits snugly over the end portion of the shaft 66 having the flats 78 and 80. Likewise, the gear 88 of the second pair 26 has a shape like that shown in FIG. 6 and a central opening that is snugly received over the shaft portion having the flats 82 and 84. Thus, the two gears 60 and 88 are interconnected for concurrent rotation, being connected to the shaft 66 journaled at the ends 70 and 72 in the end sections 22 and 24, respectively, of the housing assembly.

Figure 7:
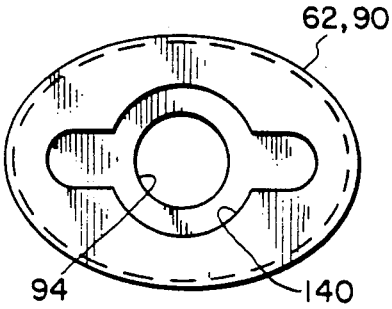
FIG. 7 is a side view of the idler gears in the two gear pairs.
Figure 8:
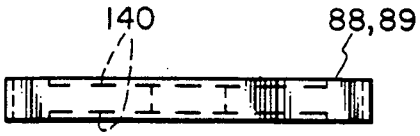
FIG. 8 is an edge view of the idler gear of the second gear pair.
Figure 12:
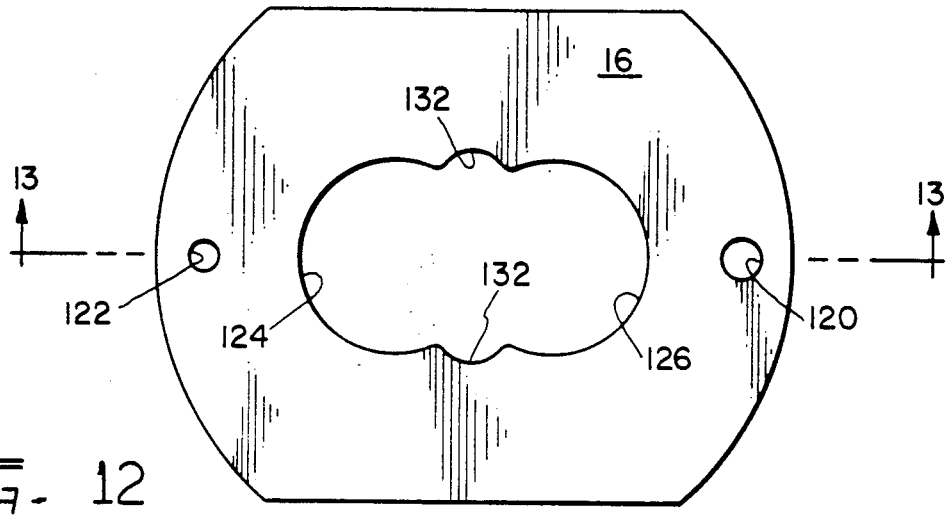
FIG. 12 is an elevational view of that section of the housing assembly that contains the second gear pair of FIG. 8.
Figure 13:
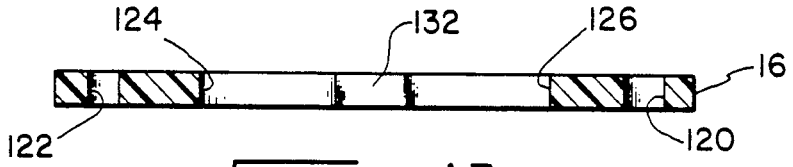
FIG. 13 is a section taken substantially along section line 13—13 of FIG. 12.
Figure 14:
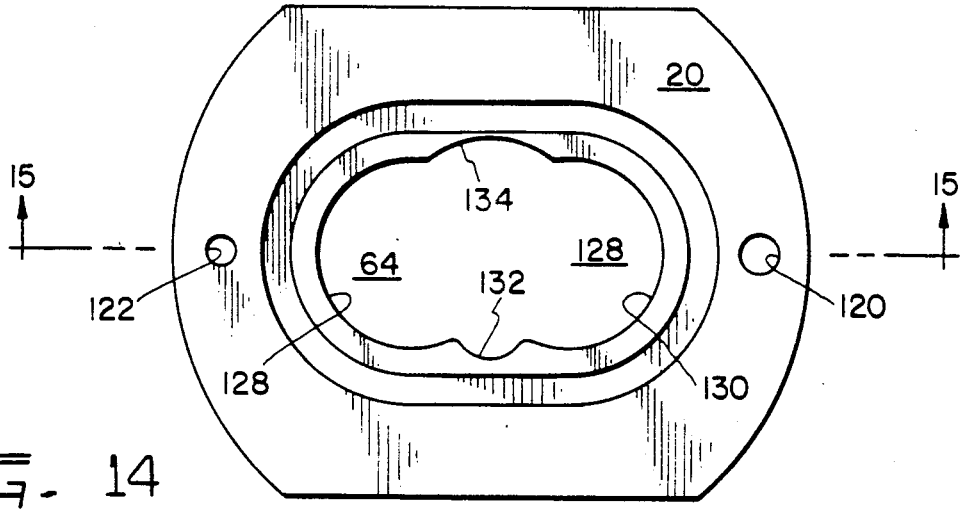
FIG. 14 is a front view of the section of the housing that contains the first gear pair.
Figure 15:
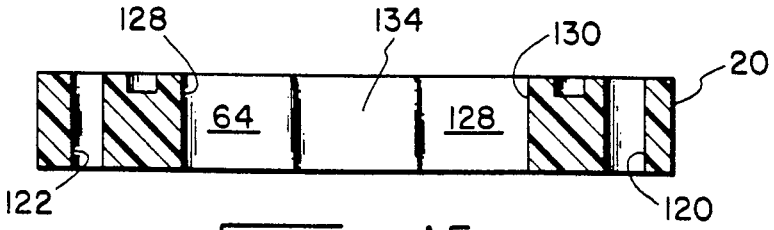
FIG. 15 is a cross-section taken substantially along section line 15—15 of FIG. 14.

Continuing with the second gear pair 26, the remaining gear thereof indicated by the numeral 90 is meshed with the gear 88. Thus gear pair 26 is received for rotation within the gear chamber 92 (FIGS. 12 and 13) in the housing section 16. The two gears 62 and 90 (FIG. 7) are each provided with a cylindrical central opening 94 which rotatably mounts the two gears on a shaft 96 snugly received by companion sockets in the two end sections 14 and 22.

It should be noted at this point that all four gears 60, 62, 88 and 90 have congruent shapes and the same gear size and pitch, the primary differences between the pairs 24, 26 being the thicknesses as clearly shown in FIG. 2 which are essentially the same as the thicknesses of the housing sections 16 and 20. The center section 18 of the housing assembly is a flat piece that rotationally receives therethrough the cylindrical center section of shaft 66 which is provided with a suitable sealing ring 98 that prevents leakage between the two gear chambers 64 and 92. The center section 18 also receives therethrough in sealing relation the idler shaft 96 as shown more clearly in FIG. 2.

The mating faces of the various housing sections 14-22 are flat and parallel with the end sections 14 and 22 being provided with grooves 100 and 102 (FIG. 10) for receiving O-ring seals 104 and 106, respectively. Similarly, the housing section 18 is provided with a sealing ring groove 108 that receives O-ring seal 110. Housing section 20 has groove 112 that receives the O-ring seal 114.

For securing all of the housing sections together and retaining them in proper alignment are dowel pins 116 and 118 which are press fitted into through openings 120 and 122. As shown more clearly in FIGS. 10, 12, 14 and 16, the openings 120 in the housing sections are larger than the other openings 122, this being for the purpose of receiving different sized dowel pins for assuring proper alignment of the housing sections during assembly.

The chambers 64 and 92 for the gear pairs 24 and 26, respectively, are shaped as shown in FIGS. 12, 13, 14 and 15. They are substantially identical except for the thicknesses, each being formed of two circular sections which have the same diameter and which intersect. These circular sections, otherwise termed as gear pockets, are indicated by the numerals 124 and 126 in FIG. 12 and 128 and 130 in FIG. 14. The centers of these gear pockets are common with the centers of rotation of the respective gears received therein.

It will be noted that the mid portions of the chambers 64 and 92 each have small curvatures 132 which are congruent and adjacent to the respective inlet and outlet ports 48, 56, 58 (FIGS. 3 and 10) in the housing sections 14 and 22 as shown. However, with respect to the housing section 20, the curved portion 134 is of a larger radius adjacent port 50 (FIG. 3) for a purpose to be later explained.

Figure 9:
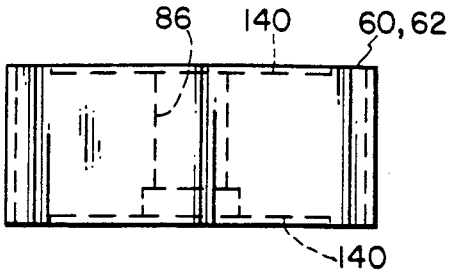
FIG. 9 is an edge view of the drive gear of the first gear pair.
Figure 9B:
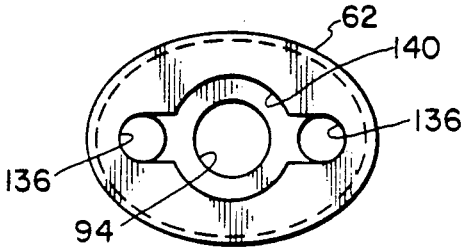
FIG. 9B is a front view of the same gear showing the location of the permanent magnets as well as a recess around the central portion of the gear for capturing liquid used as a lubricating medium.
Figure 9A:
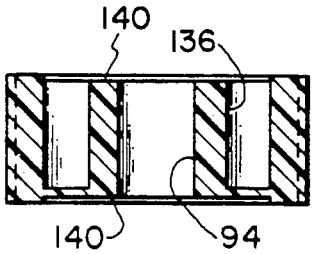
FIG. 9A is a longitudinal sectional view of the idler gear of the drive gear pairs showing pockets therein for permanent bar magnets.

In a further embodiment, the gear 62 has two axially extending cylindrical pockets 136 (FIGS. 9A, 9B) or having fixed therein two permanent bar magnets 138 (FIG. 3). These bar magnets are located on the major axis of the gear 62 equidistant from the gear center to balance each other. These are so positioned to cooperate with a Hall effect device 140 (FIG. 2) for the purpose of counting rotations of the gear 62.

An additional feature of this invention resides in providing symmetrical recesses 140 in the opposite sides of all of the gears for receiving small quantities of liquid which serve as lubricating media between the gear and the contiguous portions of the respective housing sections that enclose the gear chambers.

Figure 16:
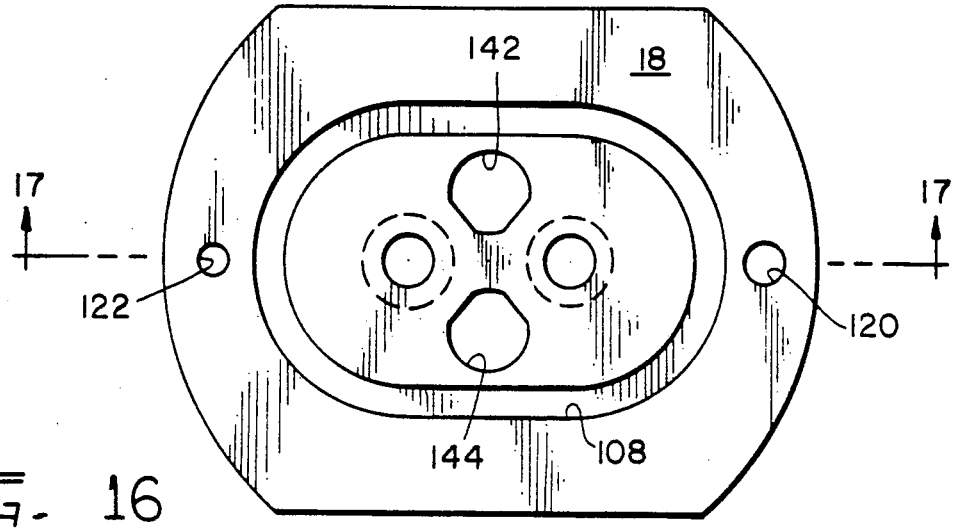
FIG. 16 is a view of one side of the center section of the housing.
Figure 17:
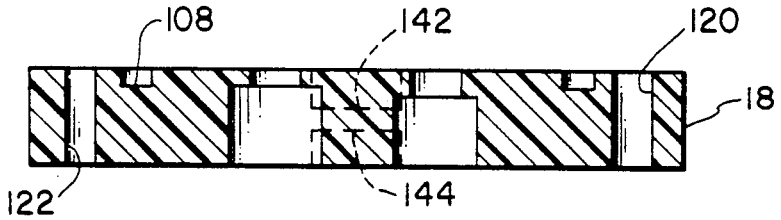
FIG. 17 is a cross-section taken substantially along section line 17—17 of FIG. 16.
Figure 18:
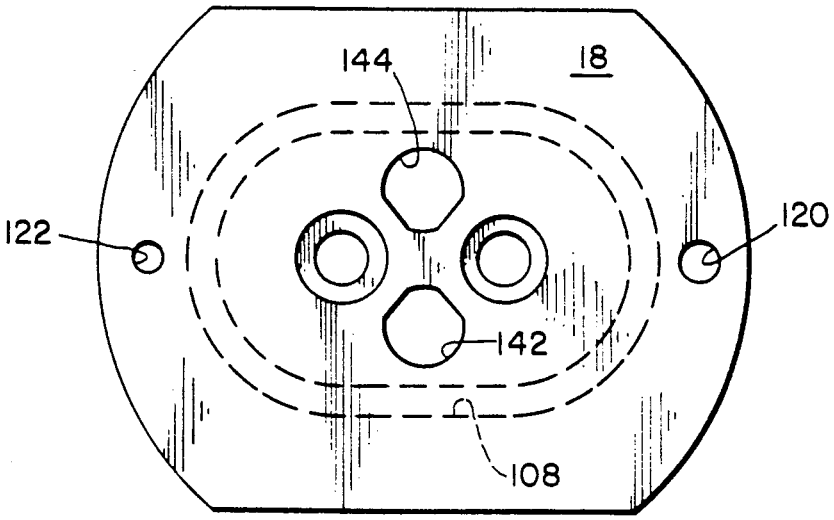
FIG. 18 is a view of the other side of the center housing section.

As shown in FIGS. 2, 16 and 18, the center section 18 of the housing is provided with two shallow cavities 142 and 144 on each side thereof in registry with the in)et and outlet ports 48, 50, 56, 58 for the gear pairs 24 and 26.

Figure 10:
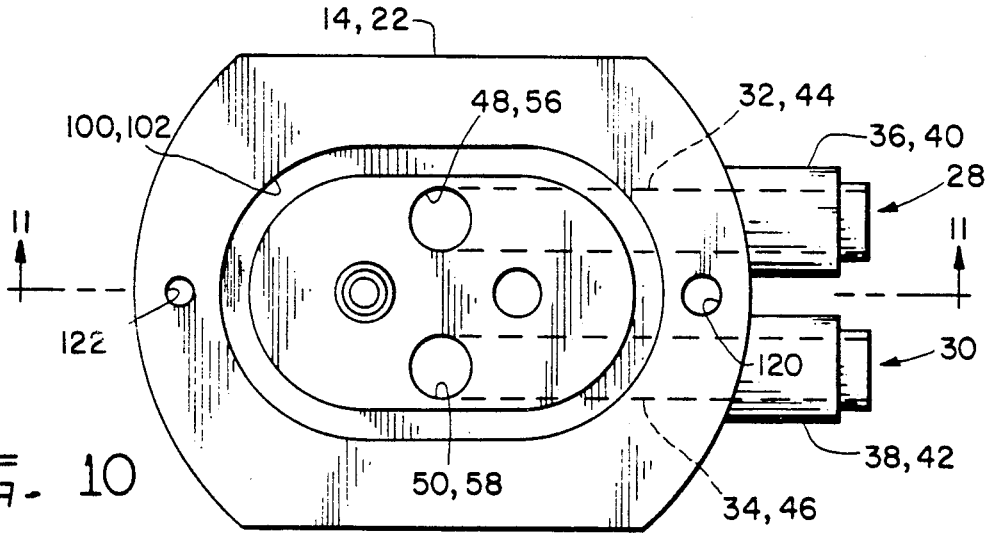
FIG. 10 is an elevational view of the two housing ends.
Figure 11:
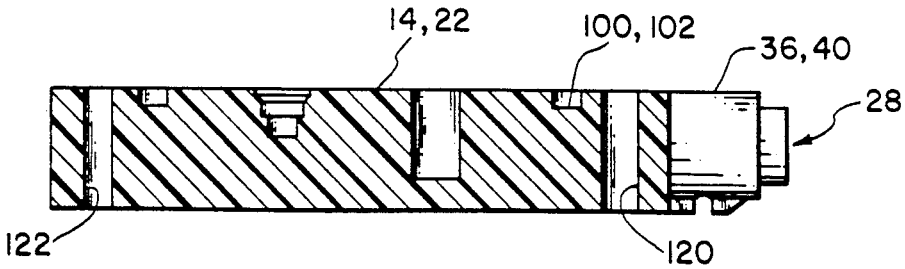
FIG. 11 is a cross-section taken substantially along section line 11—11 of FIG. 10.

In operation, two different sources of liquid, such as water and flavored syrup are connected to the inlet fittings 36 and 40 (FIG. 1). The water source is under suitable pressure, flowing through passage 32 and out of port 48 into the inlet chamber 144 (FIG. 3) of the first gear pair 24. The pressure of the water in chamber 144 exerted against that portion of the gear 60 between its seal point 146 with the gear 62 and the seal point 148 with the edge of the pocket 64 causes the gear 60 to rotate clockwise (FIG. 3) thereby rotating the gear 62. The shaft 66 imparts the same rotation to the syrup gear 88 and gear 90. This results in flavored syrup being drawn through the inlet 40, the corresponding passage 44 and the outlet 56 in the housing section 14 to be swept around to the outlet port 58 (FIG. 10). Correspondingly, the water introduced into the inlet section 144 (FIG. 3) sweeps around the gear pocket 128 (FIG. 14) and into the outlet chamber portion 150 where it exits the port 50 of the housing section 22, the passage 58 and out of the outlet spigot 38. Thus, water that exits the outlet fitting 38 and syrup from the fitting 42 are in quantities as determined by the displacement volume of the two gear pairs 24 and 26. Since the gear pair 26 is much thinner (and has a much smaller flow displacement per revolution), such as one-fifth that of the gear pair 24, five times as much water will be discharged from the fitting 38 than syrup from the fitting 42. These dispensed quantities may be discharged into a drinking vessel where they will mix or into a common spigot before discharging into a drinking vessel. The water that is introduced into the inlet fitting 36 may be carbonated such that the emerging mixture will be in the form of a carbonated beverage.

Of importance is the fact that the input water being under pressure and flowing into the inlet chamber 144 (FIG. 3) of the gear pair 24 acts against the edge of the driving gear 60 to rotate it clockwise thereby powering both gear pairs 24 and 26. It may now be explained that the radius 134 (FIG. 14) is made larger than the radius 132 for the purpose of disposing the seal point 148 (FIG. 3) farther clockwise than it would be if the radius 134 were the same size as the radius 132. This assures that the resultant vector of the pressure of the liquid applied against the edge of the gear 60 between the two seal points 146 and 148 will not be through the center of the gear 60 but instead will be offset to the lower side thereof (as viewed in FIG. 3) thereby providing a lever arm that assures rotation of the gear 60. This assures starting rotation of the gear 60 from any position within its gear pocket 128. If the radius 134 Were the same as 132 (FIG. 14), there will result rotational positions of the gear 60 Within its pocket 128 at which the resultant vector will be either through or very near the center of the gear 60 in which event the latter will not start rotation.

While there have been described above the principles of this invention in connection with a specific device, it is to be clearly understood that description is made only by way of example and not as limitation to the scope of the invention.

What is claimed is:

1. A ratio device for dispensing first and second liquids in a pre-selected ratio comprising a housing assembly having two pairs of inlets and outlets. a first pair of oval gears in said housing having meshing teeth, rotation of said gears operating to receive said first liquid through the inlet and to force it out of the outlet of the respective one of said two pairs of inlets and outlets, a second pair of oval gears in said housing having meshing teeth, rotation of said second gears operating to receive said second liquid through the inlet and to force it out of the outlet of the other of said two pairs of inlets and outlets, means interconnecting said first and second pairs of gears for concurrent rotation, and said gear pairs being of different displacement such that the volume of said first liquid dispensed from the outlet of said first pair is correspondingly different from the volume of said second liquid dispensed from the outlet of said second pair.

2. The ratio device of claim 1 including means for operating said first pair of gears as a motor in response to liquid pressure thereby to drive rotationally said second pair of gears.

3. The ratio device of claim 2 wherein said gear pairs are of different physical size.

4. The ratio device of claim 3 wherein said two gear pairs are received within two gear chambers, respectively, said operating means including one chamber for said drive gears which is shaped to receive liquid flow from the inlet of said one pair and to apply the force of said flow continuously to one of said drive gears throughout the rotation thereof.

5. The ratio device of claim 4 wherein all of said gears are of the same oval size, gear size and gear pitch, the first gear pair being of the same thickness, the gears of the second pair having the same thickness, the thicknesses of the two gear pairs being different, the thicknesses of the chambers being substantially equal to the thicknesses of said gear pairs, respectively.

6. The ratio device of claim 5 wherein said interconnecting means includes a shaft fixedly secured to one gear each of said two gear pairs.

7. The ratio device of claim 6 wherein said chambers have sidewalls that are flat and parallel, said gears having opposite surfaces that are flat and parallel, said gear surfaces having shallow recesses therein adapted to carry liquid therein that serves as a lubricating medium between the gears and the respective chamber walls.

8. The ratio device of claim 7 wherein said chambers each have the shape of two intersecting circles which form two gear pockets that receive in sealing relation the respective gears, the chamber spaces between said pockets serving as inlet and outlet portions, each pocket providing sealing engagement with the respective gear over a predetermined arcuate extent, said one drive gear having an arcuate portion within its inlet chamber portion which extends between the two seal points with the other drive gear and the respective pocket, said arcuate portion providing a resultant force vector from the liquid pressure within said inlet chamber portion that intersects the radius of said one drive gear at a point offset from the gear center which provides a lever arm that urges said drive gear in a direction of driving rotation.

* * * * *